US005398621A

United States Patent [19]

Tanaka et al.

[11] Patent Number: 5,398,621

[45] Date of Patent: Mar. 21, 1995

[54] WHEEL STOPPER FOR A MULTILEVEL PARKING SYSTEM

[75] Inventors: Kenjiro Tanaka; Kouji Tanaka, both of Yamanashi, Japan

[73] Assignee: Cartance Japan Co., Ltd., Yamanashi, Japan

[21] Appl. No.: 186,116

[22] Filed: Jan. 25, 1994

[30] Foreign Application Priority Data

Jan. 27, 1993 [JP] Japan ..... 5-001722 U

[51] Int. Cl.[6] ..... B65D 19/44

[52] U.S. Cl. ..... 108/55.3; 414/228

[58] Field of Search ..... 108/55.3, 51.1, 52.1; 414/228, 229, 230, 233

[56] References Cited

U.S. PATENT DOCUMENTS

| | | | |
|---|---|---|---|
| 1,812,861 | 7/1931 | Chase | 108/51.1 |
| 2,579,688 | 12/1951 | McCormick | 414/228 X |
| 3,270,898 | 9/1966 | Kuipers | 414/228 |
| 3,706,356 | 12/1972 | Herbst et al. | 414/228 X |
| 4,062,300 | 12/1977 | Real | 108/55.3 X |
| 4,940,380 | 7/1990 | Ballyns et al. | 108/51.1 X |

FOREIGN PATENT DOCUMENTS

| | | | |
|---|---|---|---|
| 0027067 | 1/1990 | Japan | 414/233 |
| 3059269 | 3/1991 | Japan | 414/233 |

*Primary Examiner*—James R. Brittain
*Assistant Examiner*—Janet M. Wilkens
*Attorney, Agent, or Firm*—Kanesaka & Takeuchi

[57] ABSTRACT

A wheel stopper includes a pair of stopper recesses (14) provided on a parking pallet (10) for receiving a pair of front or rear wheels, each recess having a floor plate with a pair of through-holes (18) therein and a pair of support members (15) which are movable upwardly and downwardly within the stopper recesses (14). The support members (15) consist of a support plate (19) and a pair of legs (20) extending downwardly from the support plate (19) through the through-holes (18).

3 Claims, 8 Drawing Sheets

WHEEL STOPPER FOR A MULTILEVEL PARKING SYSTEM

BACKGROUND OF THE INVENTION

1. Field of the Invention

The present invention relates to wheel stoppers for a multilevel parking apparatus for positioning a vehicle on the parking pallet and holding the vehicle firmly in place when the parking pallet is lifted or lowered.

2. Description of the Prior Art

Japanese Patent Application Kokoku No. 62-52117 discloses a parking apparatus which permits the moving of a car on the upper or lower level without moving cars on the adjacent lower and upper levels. As FIG. 1 shows, the parking pallet 1 of the parking apparatus has a pair of stopper recesses 2 to receive a pair of rear wheels of a vehicle thereby positioning and holding the car in place when the parking pallet is moved upwardly or downwardly.

However, it has been difficult to make the stopper recesses 2 sufficiently deep to ensure the aforementioned functions because if the depth of the stopper recesses 2 is too large, the front wheels are trapped in the stopper recesses 2, making it difficult to position the car in place on the parking pallet 1 and, even if successfully positioned, then the rear wheels can slip within the deep stopper recesses 2 so that the car cannot get out of the parking pallet 1.

SUMMARY OF THE INVENTION

Accordingly, it is an object of the invention to provide a wheel stopper for solving the above problem.

According to the invention, the above problem is solved by decreasing the depth of the stopper recesses when a car is driven onto the parking pallet and increasing it when the parking pallet is lifted from the ground.

According to one aspect of the present invention there is provided a wheel stopper for a multilevel parking apparatus having at least one parking pallet, which includes at least one pair of stopper recesses arranged on the parking pallet so as to receive a pair of front or rear wheels of a vehicle, each of the stopper recesses having a floor plate with at least one through-hole therein; and at least one pair of support members, each having a support plate loosely fitted in each of the stopper recesses so as to be movable upwardly and downwardly within the stopper recesses and at least one leg extending downwardly from the support plate through the through-hole.

According to another aspect of the invention there is provided a wheel stopper for a multilevel parking apparatus having at least one parking pallet, which includes at least one pair of stopper recesses provided on the parking pallet so as to receive a pair of front or rear wheels of a vehicle, each of the stopper recesses having a floor plate with at least one through-hole therein; and at least one pair of projection members each extending upwardly from a ground so as to come through the through-hole when the parking pallet is on the ground.

According to still another aspect of the invention there is provided a wheel stopper for a multilevel parking apparatus having at least one parking pallet, which includes at least one pair of stopper recesses provided on the parking pallet so as to receive a pair of front or rear wheels of a vehicle, each of the stopper recesses having a floor plate with at least one through-hole therein; at least one pair of support plates, each placed on the floor plate within the stopper recess; and at least one pair of projection members, each extending upwardly from a ground through the through-hole to push up the support plate when the parking pallet is on the ground.

When the parking pallet is put on the ground, the legs of the support plates are pushed upwardly by the ground so that the support plates are moved upwardly almost up to the upper surface of the parking pallet. As a result, the depth of the stopper recesses becomes so small that the wheels fall only slightly. On the other hand, when the parking pallet is lifted from the ground, the legs go downwardly through the through-holes so that the support plates go downwardly until they hit the floor plates of the stopper recesses. Thus, the depth of the stopper recesses becomes so large that the wheels are secured in the stopper recesses.

The above and other objects, features, and advantages of the invention will be more apparent from the following description when taken in conjunction with the accompanying drawings.

DESCRIPTION OF THE PREFERRED EMBODIMENT

Figure 1:
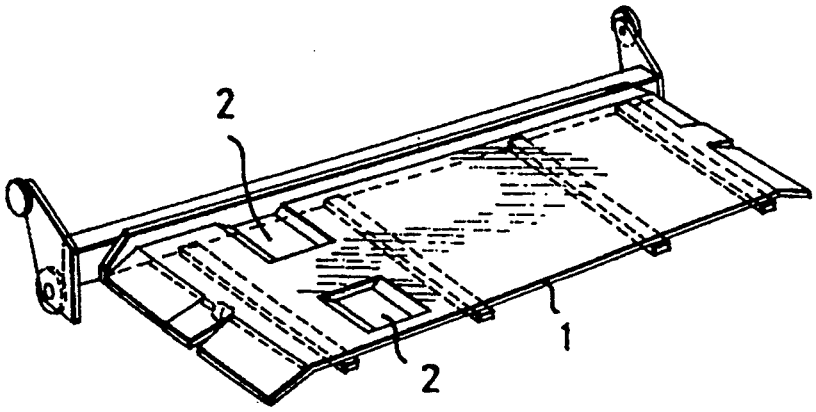
FIG. 1 PRIOR ART
FIG. 1 is a perspective view of a conventional parking pallet with wheel stoppers.
Figure 2:
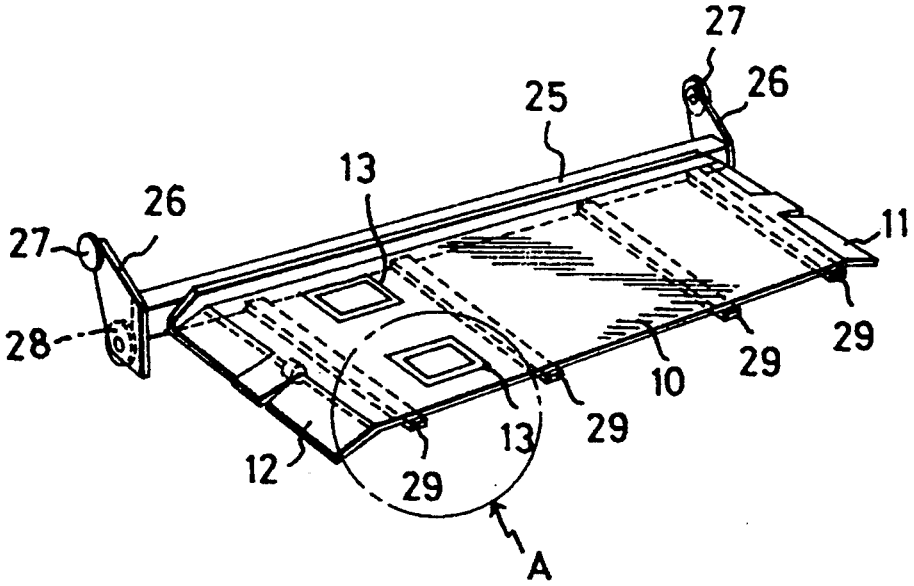
FIG. 2 is a perspective view of a parking pallet with a wheel stopper according to an embodiment of the invention.

In FIG. 2, a parking pallet 10 includes a rectangular steel plate made in the same manner as the conventional one and elongated in the front-rear (longitudinal) direction. A pair of flaps 11 and 12 are provided in the front and rear edges of the parking pallet 10 in order to facilitate driving a car onto or off from the parking pallet 10. A number of reinforcing bars 29 are attached to the back side of the parking pallet 10 at regular intervals. A pair of stopper members 13 are provided toward the rear end of the parking pallet 10. It is noted that the structure of the stopper members 13 is different from that of the conventional as described below.

An elongated reinforcing member 25 is attached to a side of the parking pallet 10. A pair of roller supports 26 are attached to opposite ends of the reinforcing member 25. Rollers 27 and 28 are pivoted to the upper outer side and the lower inner side, respectively, of each of the roller supports 26.

Figure 3:
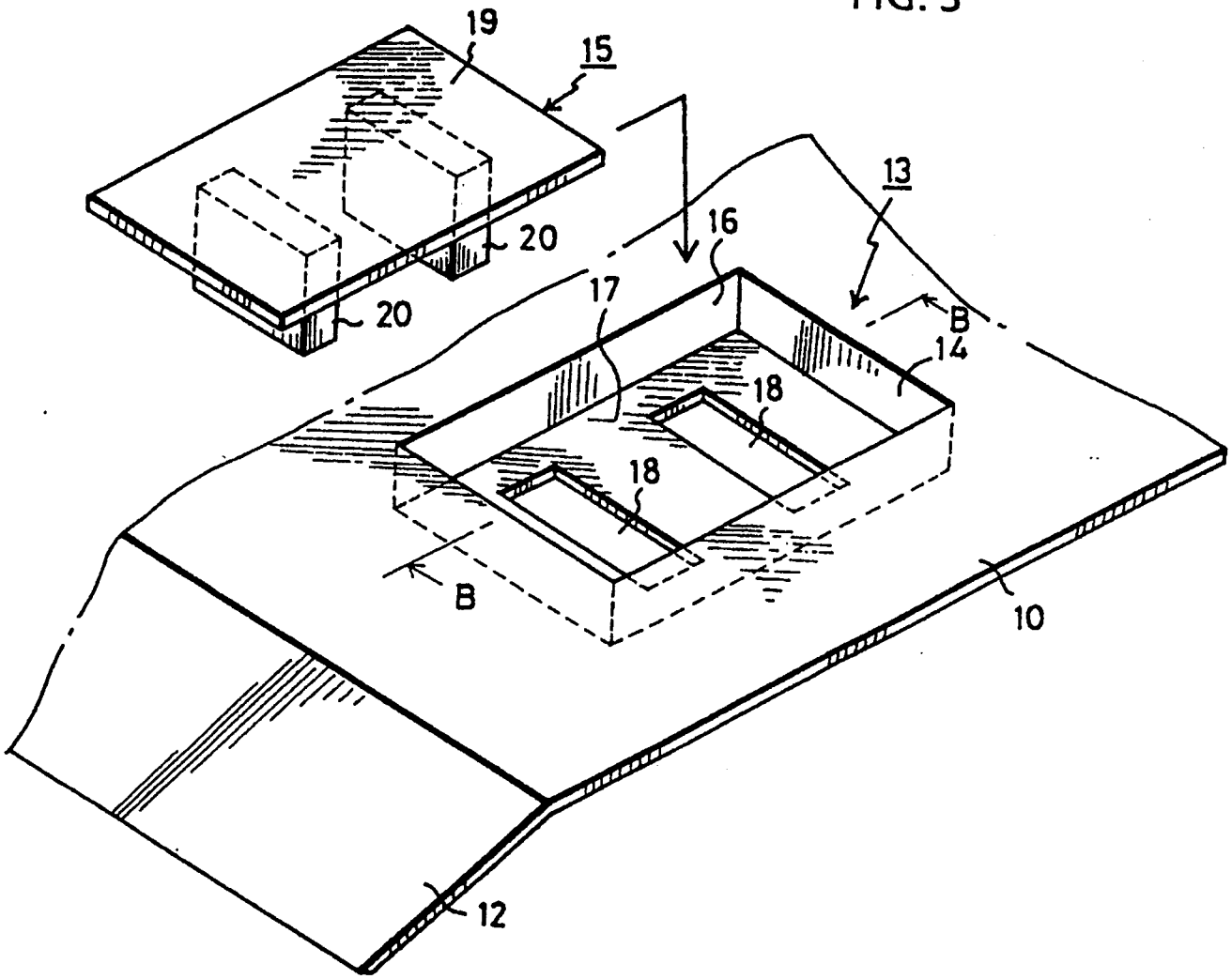
FIG. 3 is an enlarged view of a portion (A) in FIG. 2.

In FIG. 3, the wheel stopper member includes a stopper member 13 with a rectangular stopper recess 14 and a support member 15 which is movable upwardly and downwardly in the stopper recess 14. The stopper recess 14 has four side walls 16 and a floor plate 17. A pair of rectangular through-holes 18 are provided in the floor plate 17 and elongated in a direction perpendicular to the longitudinal direction. The support member 15 includes a flat support plate 19 having a shape similar to that of the rectangular stopper recess 14 and a pair of legs 20 extending downwardly from the support plate 19. The legs 20 are arranged in the positions corresponding to the through-holes 18 and have a cross-section such that the legs are loosely fitted into the through-holes 18. Consequently, the support plate 19 is movable upwardly and downwardly within the stopper recess 14 as the legs 20 moves upwardly and downwardly through the through-holes 18.

Figure 4:
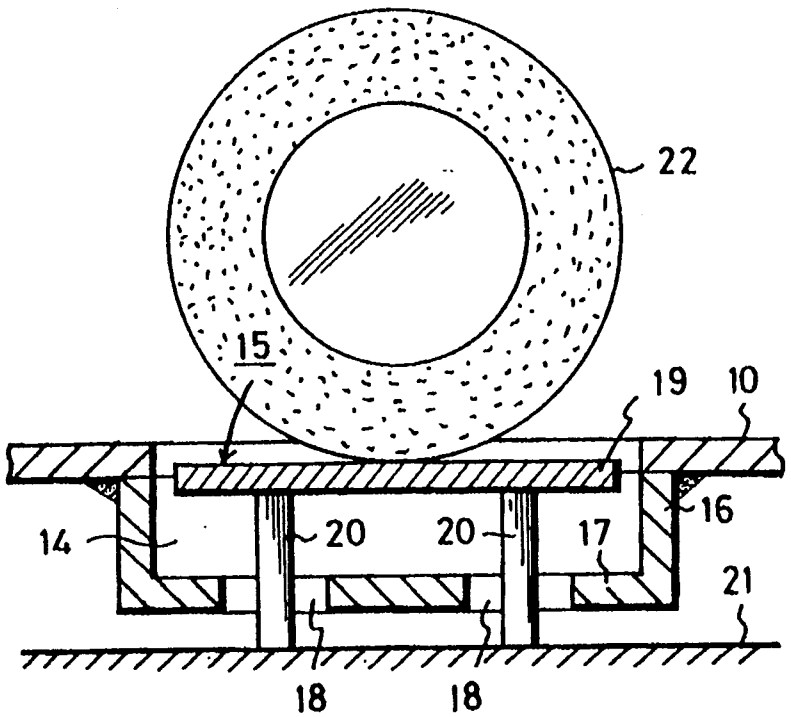
FIG. 4 is a sectional view taken along line B—B of FIG. 3, wherein the support member supports the rear wheel.
Figure 5:
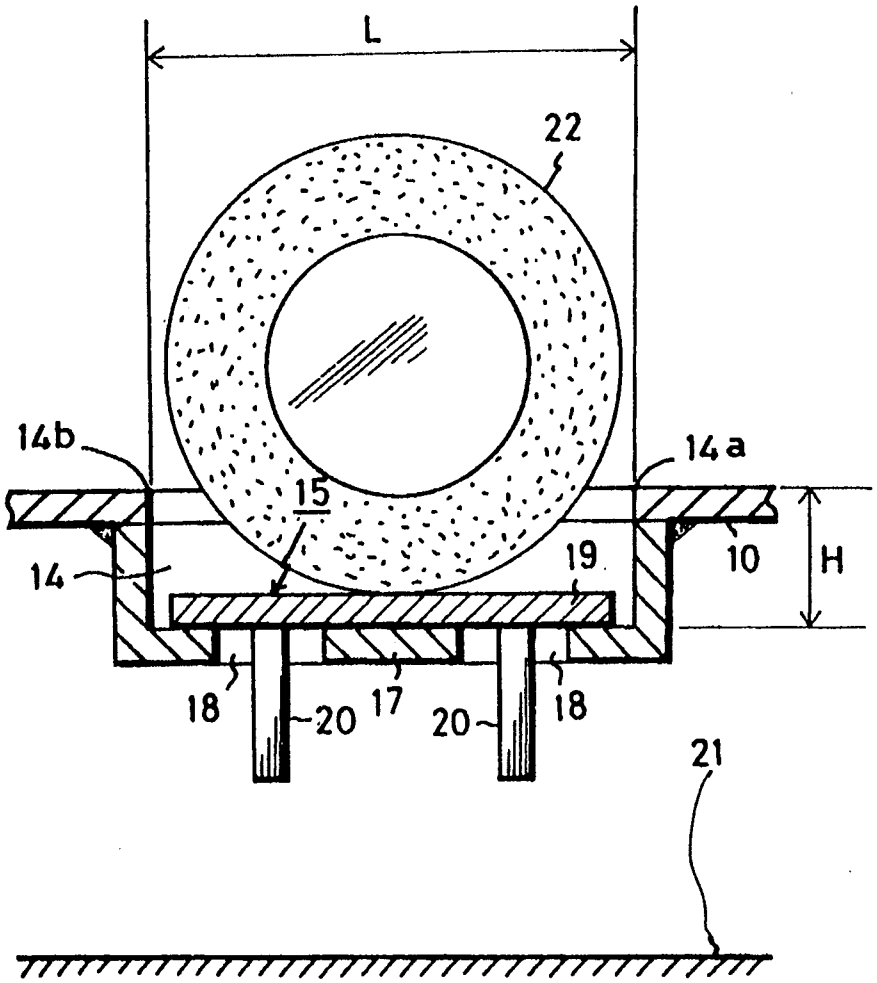
FIG. 5 is a sectional view taken along line B—B of FIG. 3, wherein the rear wheel is received by the stopper recess.

Thus, when the parking pallet 10 is on the ground 21 as shown in FIG. 4, the legs 20 are pushed upwardly to bring the support plate 19 into the upper position within the stopper recess 14, whereas when the parking pallet 10 is lifted from the ground 21 as shown in FIG. 5, the legs 20 go downwardly through the through-holes 18 so that the support plate 19 goes downwardly until it hits the floor plate 17 of the stopper recess 14.

The preferred length of the legs 20, which depends on the distance between the ground 21 and the upper surface of the parking pallet 10 when the parking pallet 10 is on the ground 21, is such that the support plate 19 is slightly lower than the upper surface of the parking pallet 10 as shown in FIG. 4. The preferred depth (H) of the stopper recess 14 as shown in FIG. 5 is such that the rear wheels will not come off from the stopper recesses 14 in the case of earthquakes, etc. and ranges from five to 10 cm. The preferred length (L) of the stopper recesses 14 is such that the large rear wheel received in the stopper recess 14 touches neither front nor rear edges 14*a* and 14*b* of the stopper recess 14.

The function of the wheel stopper is as follows. Firstly, how to park a car on the parking pallet 10 will be described. As FIG. 4 shows, when the parking pallet 10 is lowered to the ground 21, the legs 20 of the support members 15 are brought into contact with the ground 21. Consequently, the support plates 19 of the support members 15 are brought up to a point which is slightly lower than the upper surface of the parking pallet 10, thus making the stopper recesses shallow. Under this condition, a car is driven onto the pallet 10 until the rear wheels 22 are positioned on the support plates 19 of the support members 15. Since the support plates 19 are lower than the upper surface of the parking pallet 10, it is easy for the driver to sense that the rear wheels 22 are received by the stopper recesses 14.

When the rear wheels 22 are positioned, the parking pallet 10 is lifted. As a result, the support plates 19 go downwardly so that the rear wheels 22 sink deeply in the stopper recesses 14. Thus, the rear wheels 22 will not come off from the stopper recesses 14 even if the parking pallet 10 is shaken by earthquakes, etc. The support members 15 are elevated together with the parking pallet 10, with their legs 20 projected through the floor plates 17 as shown in FIG. 5.

How to leave the parking pallet is as follows. The rear wheels 22 are deep inside the stopper recesses 14 until the descending parking pallet 10 reaches the ground. When the parking pallet 10 reaches the ground 21, the legs 20 of the support members 15 contact the ground 21 so that the support plates 19 of the support members 15 are pushed upwardly. Consequently, the rear wheels 22 are supported again by the support plates 19 of the support members 15 which are only slightly lower than the upper surface of the pallet 10 as shown in FIG. 3. Thus, the rear wheels 22 can readily get on the upper surface of the parking pallet 10 without slipping.

Figure 6:
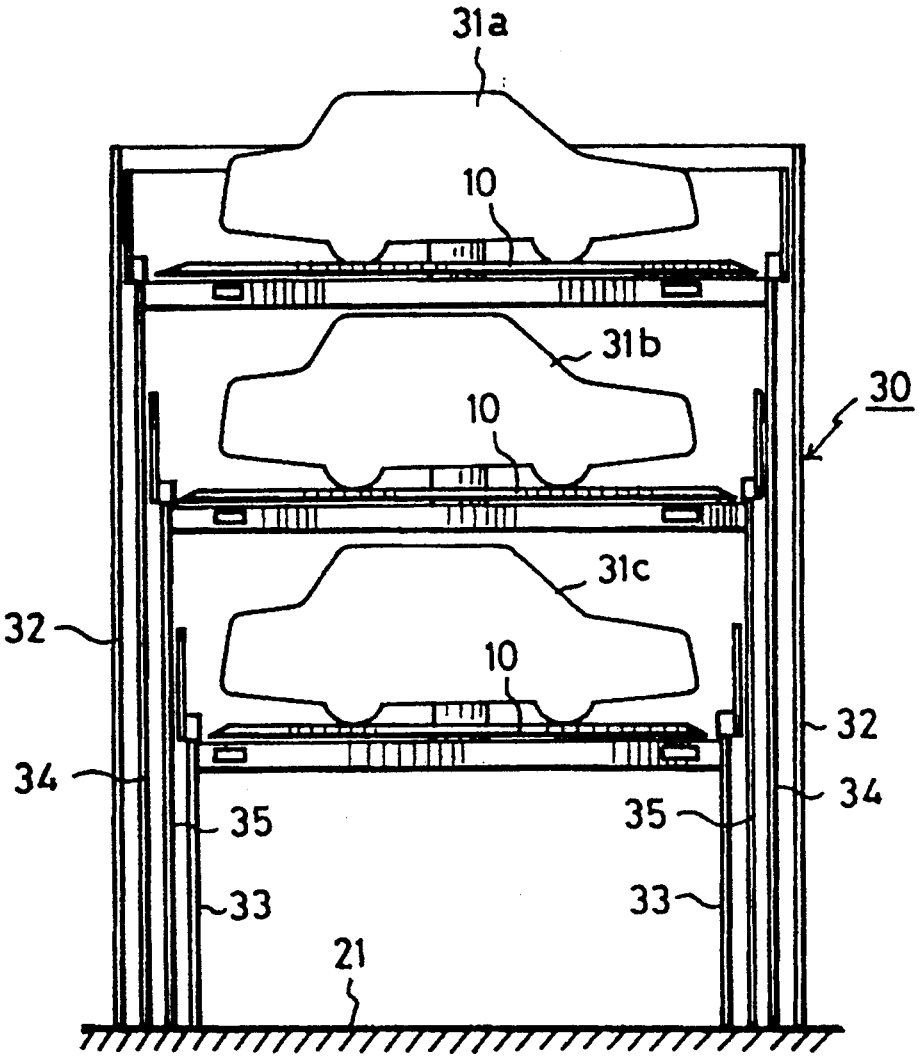
FIG. 6 is a front view of a multilevel parking apparatus using the parking pallet according to the invention.

The aforementioned parking pallet 10 is used for a multilevel parking apparatus as shown in FIGS. 5 and 6.

Figure 7:
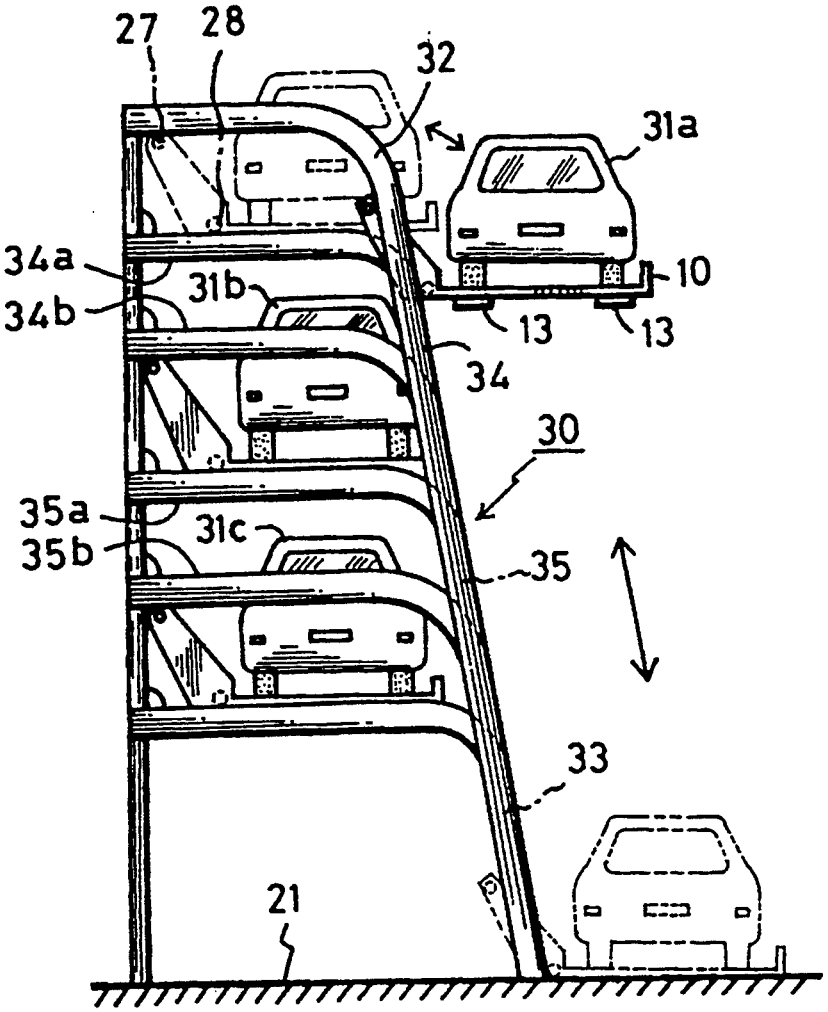
FIG. 7 is a side view of the multilevel parking apparatus.

In FIGS. 6 and 7, a multilevel parking apparatus 30 having three parking pallets 10, allowing three cars 31*a*, 31*b*, and 31*c* to be parked in elevated positions. The parking apparatus 30 includes a pair of outer rails 32, a pair of inner rails 33, and pairs of first and second middle rails 34 and 35 arranged between the outer and inner rails 32 and 33. The first and second middle rails 34 and 35 have an F shaped configuration consisting of a vertical portion and a pair of horizontal portions 34*a* and 34*b*, and 35*a* and 35*b*, while the outer and inner rails 32 and 33 have an inverted L shaped configuration consisting of a vertical portion and a horizontal portion.

In this parking apparatus, the rollers 27 and 28 run on the adjacent two rails such that the parking pallet 10 is moved upwardly or downwardly while being kept horizontal. More specifically, the outer rollers 27 are put on the under side of the outer rails while the inner rollers 28 are put on the upper side of the adjacent inner rails. For example, the under side of the outer rails 32 and the upper side of the first middle rails 34 are used to move the parking pallet 10 for the top car 31*a*, the under side of the first middle rails 34 and the upper side of the second middle rails 35 are used to move the parking pallet 10 for the middle car 31*b*, and the under side of the second middle rails 35 and the upper side of the inner rails 33 are used to move the parking pallet 10 for the bottom car 31*c*. Thus, the respective cars 31*a*, 31*b*, and 31*c* can be parked independently without interfering the other cars. The respective parking pallets 10 are moved by using wire ropes, etc.

Figure 8:
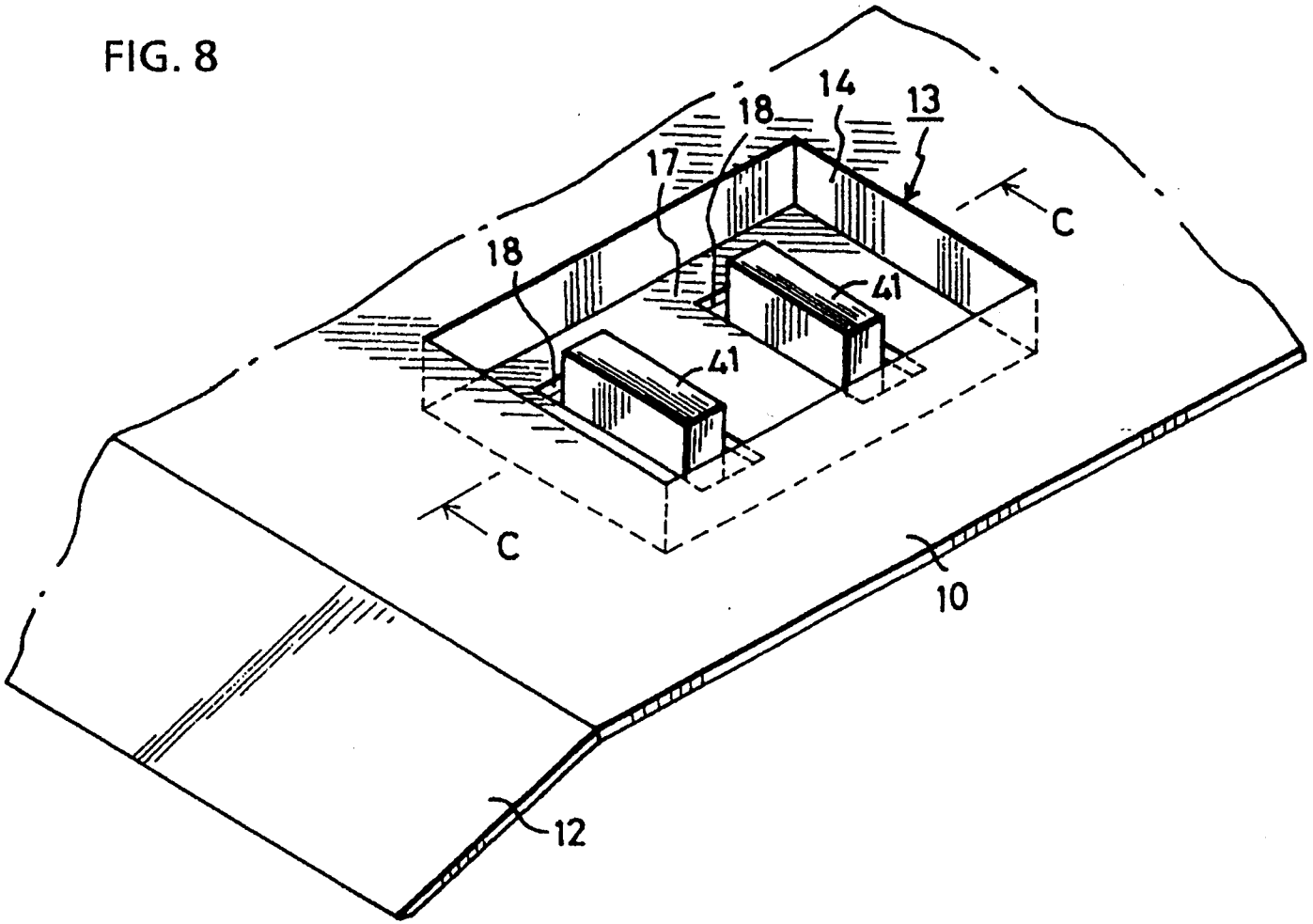
FIG. 8 is a perspective view of a wheel stopper area of a parking pallet according to another embodiment of the invention.
Figure 9:
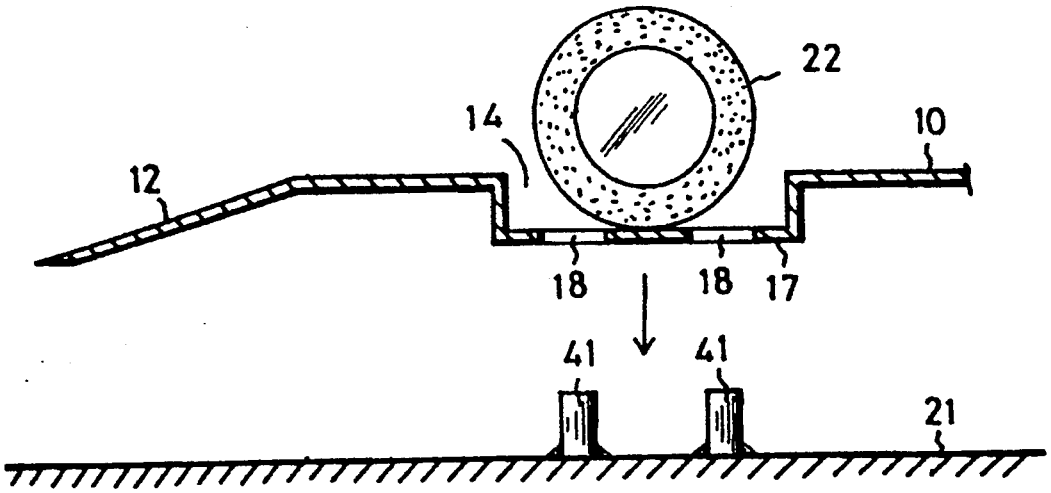
FIGS. 9 and 10 are sectional views taken along line C—C of FIG. 8 showing how the wheel stopper works.
Figure 10:
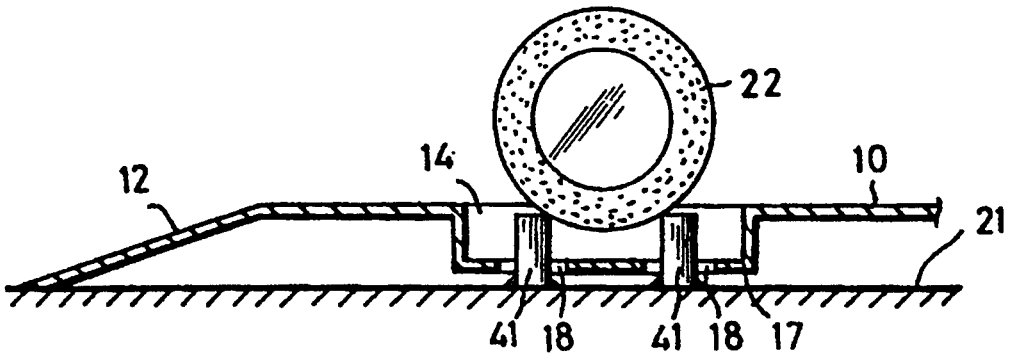

In FIGS. 8–10, a wheel stopper according to another embodiment of the invention includes rectangular stopper recesses 14 for receiving the rear wheels of a car, each having a floor plate 17 with a pair of through-holes 18, and a pair of support projections 41 extending upwardly from the ground 21 in positions corresponding to the through-holes 18. The preferred height of the support projections 41 is such that it is slightly smaller than that of the parking pallet 10 when the parking pallet 10 is on the ground 21. The support projections 41 may be made so that they always remain projected or project upwardly from the ground only when the parking pallet 10 reaches the ground 21.

When the parking pallet 10 is on the ground 21, the rear wheels 22 are supported by the support projections 41 as shown in FIG. 10. Since there are support projections 41, the front wheels can readily pass the stopper recesses 14 upon parking while the rear wheels 22 will not slip in the stopper recesses 14 upon leaving. When the parking pallet 10 is elevated above the ground, the support projections 41 are out of the stopper recesses 14 so that the rear wheels 22 rest deeply in the stopper recesses 14, producing the same results as above.

Figure 11:
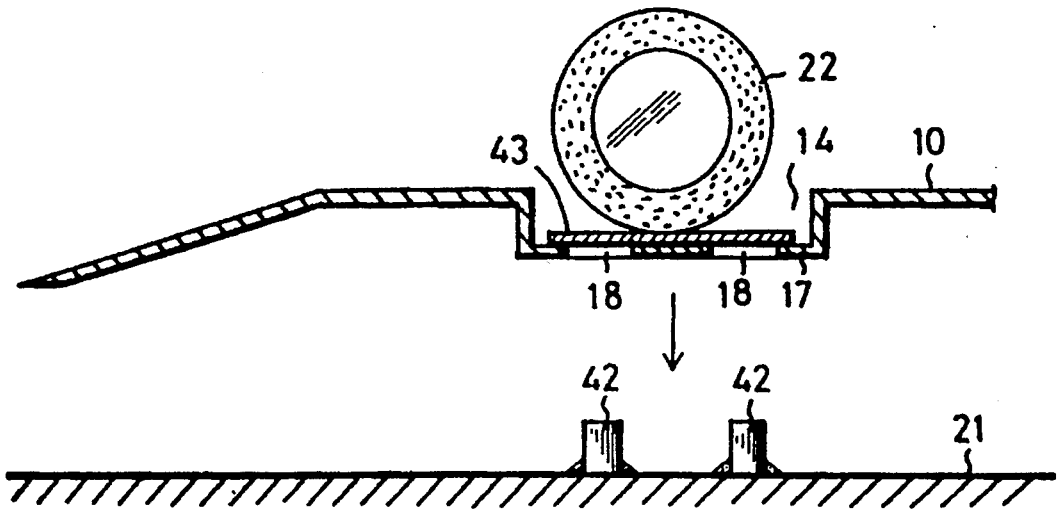
FIGS. 11 and 12 are sectional views of a wheel stopper according to a still another embodiment of the invention.
Figure 12:
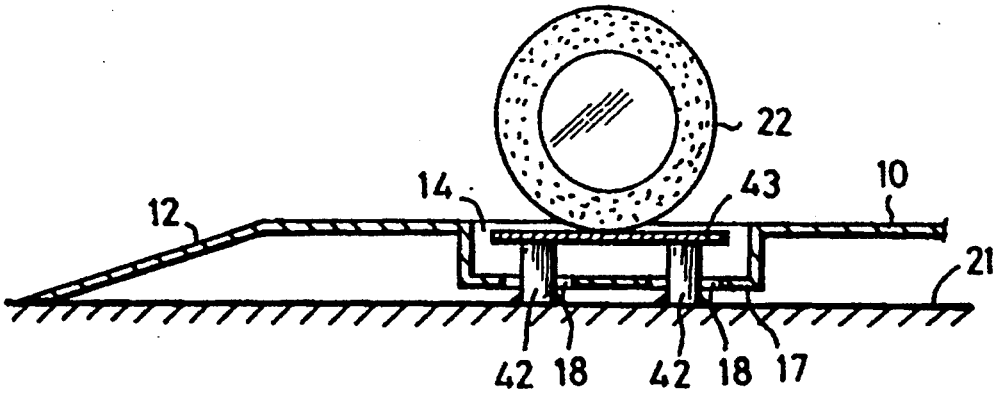

In FIGS. 11 and 12, a wheel stopper according to a still another embodiment of the invention includes a pair of rectangular stopper recesses 14 provided on the parking pallet 10 for receiving the rear wheels 22 of a car, each stopper recess 14 having a floor plate 17; a pair of through-holes 18 provided in the floor plate 17; two pairs of support projections 42, each pair of support projections being arranged on the ground 21 in the positions corresponding to the through-holes 18 in the longitudinal direction; and a pair of support plates 43 provided one for each of the stopper recesses 14. The size of the support plates 43 is such that they are loosely fitted into the rectangular stopper recesses 14. Normally, they are placed on the floor plates 17 of the stopper recesses 14, but when the parking pallet 10 is on the ground 21, the support projections 42 push them up to almost the upper surface of the pallet 10.

Thus, when the parking pallet 10 is on the ground 21, the rear wheels 22 are supported by the support plates 43 which are pushed up by the support projections 42 as shown in FIG. 12. On the other hand, when the parking pallet 10 is elevated above the ground 21, the support projections 42 come out of the stopper recesses 14 so that the support plates 43 go downwardly onto the floor plates 17 of the stopper recesses 14. Consequently, the rear wheels 22 are held deeply inside the stopper recesses 14, thus producing the same results as stated above.

While the wheel stoppers for the rear wheels have been described above, the invention may be applied to the front wheels in the same manner. Both front and rear wheels may be held by a wheel stopper, too. The wheel stoppers according to the invention may be used for the so-called elevator slide type multilevel parking apparatus in which elevators move upwardly and downwardly between left-hand and right-hand side shelves which are arranged one above another. The number of legs 20, support projections 41 and 42 may be three or more if necessary.

As have been described above, according to the invention, when the parking pallet is on the ground, the support members are projected into the stopper recesses to support the wheels so as to decrease the effective depth of the stopper recesses. As a result, the wheels can pass the stopper recesses without slipping.

On the other hand, when the parking pallet is elevated from the ground, the support members go downwardly, making the stopper recesses deeper so that the wheels are held deep inside the stopper recesses. Thus, the wheels will not come off from the stopper recesses in the case of earthquakes, etc., thus maximizing its safety.

We claim:

1. A parking pallet for a multilevel parking apparatus, the parking pallet including a wheel stopper comprising:

at least one pair of stopper recesses arranged on said parking pallet acting as a means for receiving a pair of front or rear wheels of a vehicle, each of said stopper recesses having a floor plate with at least one through-hole therein; and at least one pair of support members, each having a support plate loosely fitted in each of said stopper recesses so as to be movable upwardly and downwardly within said stopper recesses and at least one leg extending downwardly from said support plate through said through-hole.

2. A parking pallet for a multilevel parking apparatus, the parking pallet including a wheel stopper comprising:

at least one pair of stopper recesses provided on said parking pallet acting as a means for receiving a pair of front or rear wheels of a vehicle, each of said stopper recesses having a floor plate with at least one through-hole therein; and at least one pair of projection members each extending upwardly from horizontal surface through said through-hole when said parking pallet is on said horizontal surface.

3. A parking pallet for a multilevel parking apparatus, the parking pallet including a wheel stopper comprising:

at least one pair of stopper recesses provided on said parking pallet acting as a means for receiving a pair of front or rear wheels of a vehicle, each of said stopper recesses having a floor plate with at least one through-hole therein;

at least one pair of support plates, each placed on said floor plate within said stopper recess; and at least one pair of projection members, each extending upwardly from horizontal surface through said through-hole to push up said support plate when said parking pallet is on said horizontal surface.

* * * * *